US006917368B2

(12) United States Patent
Credelle et al.

(10) Patent No.: US 6,917,368 B2
(45) Date of Patent: Jul. 12, 2005

(54) SUB-PIXEL RENDERING SYSTEM AND METHOD FOR IMPROVED DISPLAY VIEWING ANGLES

(75) Inventors: Thomas Lloyd Credelle, Morgan Hill, CA (US); Moon Hwan Im, Santa Rosa, CA (US)

(73) Assignee: Clairvoyante, Inc., Sebastopol, CA (US)

( * ) Notice: Subject to any disclaimer, the term of this patent is extended or adjusted under 35 U.S.C. 154(b) by 249 days.

(21) Appl. No.: 10/379,766

(22) Filed: Mar. 4, 2003

(65) Prior Publication Data

US 2004/0174375 A1 Sep. 9, 2004

(51) Int. Cl.[7] ..... G09G 5/02

(52) U.S. Cl. ..... 345/589; 345/613; 345/614; 345/694; 345/695

(58) Field of Search ..... 345/613, 614, 345/694, 695

(56) References Cited

U.S. PATENT DOCUMENTS

| | | | |
|---|---|---|---|
| 3,971,065 | A | 7/1976 | Bayer |
| 4,353,062 | A | 10/1982 | Lorteije et al. |
| 4,593,978 | A | 6/1986 | Mourey et al. |
| 4,642,619 | A | 2/1987 | Togashi |
| 4,651,148 | A | 3/1987 | Takeda et al. |
| 4,751,535 | A | 6/1988 | Myers |
| 4,773,737 | A | 9/1988 | Yokono et al. |
| 4,786,964 | A | 11/1988 | Plummer et al. |
| 4,792,728 | A | 12/1988 | Chang et al. |
| 4,800,375 | A | 1/1989 | Silverstein et al. |
| 4,853,592 | A | 8/1989 | Strathman |
| 4,874,986 | A | 10/1989 | Menn et al. |
| 4,886,343 | A | 12/1989 | Johnson |
| 4,908,609 | A | 3/1990 | Stroomer |
| 4,920,409 | A | 4/1990 | Yamagishi |
| 4,965,565 | A | 10/1990 | Noguchi |
| 4,966,441 | A | 10/1990 | Conner |
| 4,967,264 | A | 10/1990 | Parulski et al. |
| 5,006,840 | A | 4/1991 | Hamada et al. |
| 5,052,785 | A | 10/1991 | Takimoto et al. |

(Continued)

FOREIGN PATENT DOCUMENTS

| | | |
|---|---|---|
| DE | 299 09 537 U1 | 10/1999 |
| DE | 199 23 527 | 11/2000 |
| DE | 201 09 354 U1 | 9/2001 |

(Continued)

OTHER PUBLICATIONS

Adobe Systems, Inc., website, 2002, http://www.adobe.com/products/acrobat/cooltype.html.

Betrisey, C., et al., "Displaced Filtering for Patterned Displays," 2000, *Society for Information Display (SID) 00 Digest*, pp. 296–299.

Carvajal, D., "Big Publishers Looking Into Digital Books," Apr. 3, 2000, *The New York Times*, Business/Financial Desk.

"ClearType magnified, "*Wired Magazine*, Nov. 8, 1999, Microsoft Typography, article posted Nov. 8, 1999, and last updated Jan. 27, 1999, © 1999 Microsoft Corporation, 1 page.

(Continued)

*Primary Examiner*—Matthew C. Bella
*Assistant Examiner*—G F. Cunningham

(57) ABSTRACT

System and methods are disclosed for improving the off-normal axis viewing angle by applying different filters if one colored sub-pixel data is driven close to 100% luminance while other colored sub-pixel data is driven close to 50% luminance values. Systems and methods for adjusting the viewing characteristics of the display system are also disclosed.

13 Claims, 9 Drawing Sheets

U.S. PATENT DOCUMENTS 5,113,274 A 5/1992 Takahashi et al.
5,132,674 A 7/1992 Bottorf
5,144,288 A 9/1992 Hamada et al.
5,184,114 A 2/1993 Brown
5,189,404 A 2/1993 Masimo et al.
5,233,385 A 8/1993 Sampsell
5,311,337 A 5/1994 McCartney, Jr.
5,315,418 A 5/1994 Sprague et al.
5,334,996 A 8/1994 Tanigaki et al.
5,341,153 A 8/1994 Benzschawel et al.
5,398,066 A 3/1995 Martinez-Uriegas et al.
5,436,747 A 7/1995 Suzuki
5,461,503 A 10/1995 Deffontaines et al.
5,477,240 A 12/1995 Huebner et al.
5,535,028 A 7/1996 Bae et al.
5,541,653 A 7/1996 Peters et al.
5,561,460 A 10/1996 Katoh et al.
5,563,621 A 10/1996 Silsby
5,579,027 A 11/1996 Sakurai et al.
5,648,793 A 7/1997 Chen
5,754,226 A 5/1998 Yamada et al.
5,792,579 A 8/1998 Phillips
5,815,101 A 9/1998 Fonte
5,821,913 A 10/1998 Mamiya
5,949,496 A 9/1999 Kim
5,973,664 A 10/1999 Badger
6,002,446 A 12/1999 Eglit
6,008,868 A 12/1999 Silverbrook
6,034,666 A 3/2000 Kanai et al.
6,038,031 A 3/2000 Murphy
6,049,626 A 4/2000 Kim
6,061,533 A 5/2000 Kajiwara
6,064,363 A 5/2000 Kwon
6,069,670 A 5/2000 Borer
6,097,367 A 8/2000 Kuriwaki et al.
6,108,122 A 8/2000 Ulrich et al.
6,144,352 A 11/2000 Matsuda et al.
6,160,535 A 12/2000 Park
6,184,903 B1 2/2001 Omori
6,188,385 B1 2/2001 Hill et al.
6,198,507 B1 3/2001 Ishigami
6,219,025 B1 4/2001 Hill et al.
6,225,967 B1 5/2001 Hebiguchi
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,271,891 B1 8/2001 Ogawa et al.
6,299,329 B1 10/2001 Mui et al.
6,327,008 B1 12/2001 Fujiyoshi
6,346,972 B1 2/2002 Kim
6,360,023 B1 3/2002 Betrisey et al.
6,377,262 B1 4/2002 Hitchcock et al.
6,392,717 B1 5/2002 Kunzman
6,393,145 B2 5/2002 Betrisey et al.
6,441,867 B1 8/2002 Daly
6,453,067 B1 9/2002 Morgan et al.
6,466,618 B1 10/2002 Messing et al.
6,545,740 B2 4/2003 Werner
6,661,429 B1 12/2003 Phan
2001/0017515 A1 8/2001 Kusunoki et al.
2001/0040645 A1 11/2001 Yamazaki
2002/0012071 A1 1/2002 Sun
2002/0015110 A1 2/2002 Elliott
2002/0017645 A1 2/2002 Yamazaki
2002/0122160 A1 9/2002 Kunzman
2002/0140831 A1 10/2002 Hayashi
2002/0149598 A1 10/2002 Greier
2002/0190648 A1 12/2002 Bechtel et al.
2003/0011613 A1 1/2003 Booth, Jr.
2003/0043567 A1 3/2003 Hoelen et al.
2003/0071775 A1 * 4/2003 Ohashi et al. ..... 345/89
2003/0071826 A1 4/2003 Goertzen
2003/0071943 A1 4/2003 Choo et al.
2003/0072374 A1 4/2003 Sohm
2003/0218618 A1 11/2003 Phan
2004/0075764 A1 4/2004 Law

FOREIGN PATENT DOCUMENTS

EP 0 158 366 A2 10/1985
EP 0 203 005 A1 11/1986
EP 0 322 106 A2 6/1989
EP 0 0671 650 9/1995
EP 0 793 214 A1 9/1997
EP 0 812 114 A1 12/1997
EP 0 878 969 11/1998
EP 0 899 604 A2 3/1999
EP 1 083 539 A2 3/2001
EP 1 261 014 A2 11/2002
GB 2 133 912 A 8/1984
GB 2 146 478 A 4/1985
JP 60-107022 6/1985
JP 02-000826 A 1/1990
JP 03-078390 4/1991
JP 03-36239 B 5/1991
JP 06-102503 4/1994
JP 02-983027 B2 11/1999
JP 2001203919 7/2001
KR 2001060824 * 7/2001 ..... G02F/1/1335
WO WO 97/23860 7/1997
WO WO 00/21067 4/2000
WO WO 00/42564 7/2000
WO WO 00/42762 7/2000
WO WO 00/45365 8/2000
WO WO 00/67196 11/2000
WO WO 01/10112 A2 2/2001
WO WO 01/29817 A1 4/2001
WO WO 01/52546 A2 7/2001
WO WO 02/059685 A2 8/2002
WO WO 03/014819 A1 2/2003

OTHER PUBLICATIONS

Credelle, Thomas L. et al., "P–00: MTF of High–Resolution PenTile Matrix™ Displays," *Eurodisplay 02 Digest*, 2002, pp. 1–4.

Daly, Scott, "Analysis of Subtriad Addressing Algorithms by Visual System Models," *SID Symp. Digest*, Jun. 2001, pp. 1200–1203.

Elliott, C., "Active Matrix Display Layout Optimization for Sub–pixel Image Rendering," Sep. 2000, Proceedings of the 1st International Display Manufacturing Conference, pp. 185–189.

Elliott, Candice H. Brown et al., "Color Subpixel Rendering Projectors and Flat Panel Displays," New Initiatives in Motion Imaging, SMPTE Advanced Motion Imaging Conference, Feb. 27–Mar. 1, 2003, Seattle, Washington, pp. 1–4.

Elliott, Candice H. Brown et al., "Co–optimization of Color AMLCD Subpixl Architecture and Rendering Algorithms," *SID Symp. Digest*, May 2002, pp. 172–175.

Elliott, C., "New Pixel Layout for PenTile Matrix," Jan. 2002, Proceedings of the International Display Manufacturing Conference, pp. 115–117.

Elliott, C., "Reducing Pixel Count without Reducing Image Quality," Dec. 1999, *Information Display*, vol. 15, pp. 22–25.

Feigenblatt, R.I., "Full–color imaging on amplitude–quantized color mosaic displays," *SPIE*, vol. 1075, Digital Image Processing Applications, 1989, pp. 199–204.
Gibson Research Corporation, website, "Sub–Pixel Font Rendering Technology, How It Works," 2002, http://www.grc.com/ctwhat.html.
Johnston, Stuart J., "An Easy Read: Microsoft's ClearType," *InformationWeek Online*, Redmond, WA, Nov. 23, 1998, 3 pages.
Johnston, Stuart J., "Clarifying ClearType," *InformationWeek Online, Redmond, WA*, Jan. 4, 1999, 4 pages.
"Just Outta Beta," *Wired Magazine*, Dec. 1999, Issue 7.12, 3 pages.
Klompenhouwer, Michiel A. et al., "Subpixel Image Scaling for Color Matrix Displays," *SID Symp. Digest*, May 2002, pp. 176–179.
Krantz, John H. et al., "Color Matrix Display Image Quality: The Effects of Luminance and Spatial Sampling," *SID International Symposium, Digest of Technical Papers*, 1990, pp. 29–32.
Lee, Baek–woon et al., "40.5L: Late–News Paper: TFT–LCD with RGBW Color System," *SID 03 Digest*, 2003, pp. 1212–1215.
Markoff, John, "Microsoft's Cleartype Sets Off Debate on Originality," *The New York Times*, Dec. 7, 1998, 5 pages.
Martin, R., et al., "Detectability of Reduced Blue Pixel Count in Projection Displays," May 1993, *Society for Information Display* (*SID*) *93 Digest*, pp. 606–609.
Messing, Dean S. et al., "Improved Display Resolution of Subsampled Colour Images Using Subpixel Addressing," *Proc. Int. Conf. Image Processing* (*ICIP '02*), Rochester, N.Y., IEEE Signal Processing Society, 2002, vol. 1, pp. 625–628.
Messing, Dean S. et al., "Subpixel Rendering on Non–Striped Colour Matrix Displays," *International Conference on Image Processing*, Barcelona, Spain, Sep. 2003, 4 pages.
"Microsoft ClearType," http://www.microsoft.com/opentype/cleartype, Mar. 26, 2003, 4 pages.
Microsoft Corporation, website, http://www.microsoft.com/typography/cleartype, 2002, 7 pages.
Microsoft Press Release, Nov. 15, 1998, Microsoft Research Announces Screen Display Breakthrough at COMDEX/Fall '98, PR Newswire.
Murch, M., "Visual Perception Basics," 1987, *SID*, Seminar 2, Tektronix, Inc., Beaverton, Oregon.
Okumura, H., et al., "A New Flicker–Reduction Drive Method for High–Resolution LCTVs," May 1991, *Society for Information Display* (*SID*) *International Symposium Digest of Technical Papers*, pp. 551–554.
Platt, John C., "Optimal Filtering for Patterned Displays," Microsoft Research *IEEE Signal Processing Letters*, 2000, 4 pages.
Platt, John, "Technical Overview of ClearType Filtering," Microsoft Research, http://www.research.microsoft.com/users/jplatt/cleartype/default.aspx, Sep. 17, 2002, 3 pages.
Poor, Alfred, "LCDs: The 800–pound Gorilla," *Information Display*, Sep. 2002, pp. 18–21.
"Ron Feigenblatt's remarks on Microsoft ClearType™," http://www.geocities.com/SiliconValleyRidge/6664/ClearType.html, Dec. 5, 1998, Dec. 7, 1998, Dec. 12, 1999, Dec. 26, 1999, Dec. 30, 1999, and Jun. 19, 2000, 30 pages.
"Sub–Pixel Font Rendering Technology," © 2003 Gibson Research Corporation, Laguna Hills, CA, 2 pages.
Wandell, Brian A., Stanford University, "Fundamentals of Vision: Behavior, Neuroscience and Computation," Jun. 12, 1994, *Society for Information Display* (*SID*) *Short Course S–2*, Fairmont Hotel, San Jose, California.
Werner, Ken, "OLEDs, OLEDs, Everywhere . . . ," *Information Display*, Sep. 2002, pp. 12–15.

* cited by examiner

SUB-PIXEL RENDERING SYSTEM AND METHOD FOR IMPROVED DISPLAY VIEWING ANGLES

RELATED APPLICATIONS

The present application is related to commonly owned (and filed on even date) U.S. patent applications: (1) U.S. patent application Ser. No. 10/379,767 entitled "SYSTEMS AND METHODS FOR TEMPORAL SUB-PIXEL RENDERING OF IMAGE DATA"; and (2) U.S. patent application Ser. No. 10/379,765 entitled "SYSTEMS AND METHODS FOR MOTION ADAPTIVE FILTERING," which are hereby incorporated herein by reference

BACKGROUND

In commonly owned U.S. patent applications: (1) U.S. patent application Ser. No. 09/916,232 ("the '232 application"), entitled "ARRANGEMENT OF COLOR PIXELS FOR FULL COLOR IMAGING DEVICES WITH SIMPLIFIED ADDRESSING," filed Jul. 25, 2001; (2) U.S. patent application Ser. No. 10/278,353 ("the '353 application"), entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) U.S. patent application Ser. No. 10/278,352 ("the '352 application"), entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) U.S. patent application Ser. No. 10/243,094 ("the '094 application"), entitled "IMPROVED FOUR COLOR ARRANGEMENTS AND EMITTERS FOR SUB-PIXEL RENDERING," filed Sep. 13, 2002; (5) U.S. patent application Ser. No. 10/278,328 ("the '328 application"), entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) U.S. patent application Ser. No. 10/278,393 ("the '393 application"), entitled "COLOR DISPLAY HAVING HORIZONTAL SUB-PIXEL ARRANGEMENTS AND LAYOUTS," filed Oct. 22, 2002; (7) U.S. patent application Ser. No. 10/347,001 ("the '001 application") entitled "IMPROVED SUB-PIXEL ARRANGEMENTS FOR STRIPED DISPLAYS AND METHODS AND SYSTEMS FOR SUB-PIXEL RENDERING SAME," novel sub-pixel arrangements are therein disclosed for improving the cost/performance curves for image display devices and herein incorporated by reference.

These improvements are particularly pronounced when coupled with sub-pixel rendering (SPR) systems and methods further disclosed in those applications and in commonly owned U.S. patent applications: (1) U.S. patent application Ser. No. 10/051,612 ("the '612 application"), entitled "CONVERSION OF RGB PIXEL FORMAT DATA TO PENTILE MATRIX SUB-PIXEL DATA FORMAT," filed Jan. 16, 2002; (2) U.S. patent application Ser. No. 10/150,355 ("the '355 application"), entitled "METHODS AND SYSTEMS FOR SUB-PIXEL RENDERING WITH GAMMA ADJUSTMENT," filed May 17, 2002; (3) U.S. patent application Ser. No. 10/215,843 ("the '843 application"), entitled "METHODS AND SYSTEMS FOR SUB-PIXEL RENDERING WITH ADAPTIVE FILTERING," filed Aug. 8, 2002, which are hereby incorporated herein by reference.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1:
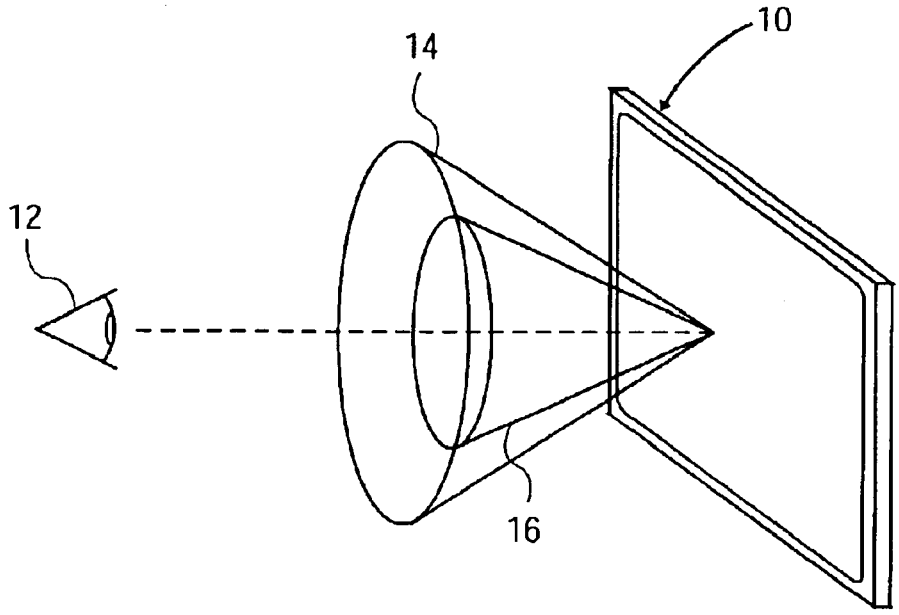
FIG. 1 depicts an observer viewing a display panel and the cones of acceptable viewing angle off the normal axis to the display.

FIG. 1 shows a display panel 10 capable of displaying an image upon its surface. An observer 12 is viewing the image on the display at an appropriate distance for this particular display. It is known that, depending upon the technology of the display device (liquid crystal display LCD, optical light emitting diode OLED, EL, and the like) that the quality of the displayed image falls off as a function of the viewing angle. The outer cone 14 depicts an acceptable cone of viewing angles for the observer 12 with a typical RGB striped system that is not performing sub-pixel rendering (SPR) on the displayed image data.

Figure 2:
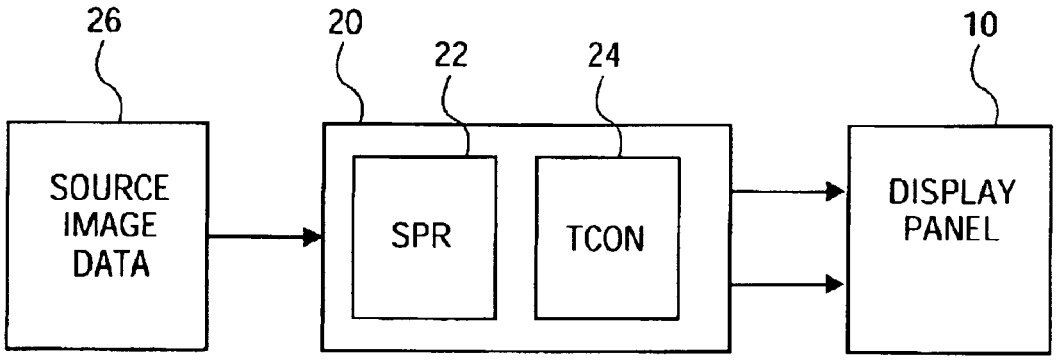
FIG. 2 shows one embodiment of a graphics subsystem driving a panel with sub-pixel rendering and timing signals.

A further reduction in acceptable viewing angle for high spatial frequency (HSF) edges (i.e. inner cone 16) may occur when the image data itself is sub-pixel rendered in accordance with any of the SPR algorithms and systems as disclosed in the incorporated applications (i.e. the '612, '355, and '843 applications) or with any known SPR system and methods. One embodiment of such a system is shown in FIG. 2 wherein source image data 26 is placed through a driver 20 which might include SPR subsystem 22 and timing controller (Tcon) 24 to supply display image data and control signals to panel 10. The SPR subsystem could reside in a number of embodiments. For example, it could entirely in software, on a video graphics adaptor, a scalar adaptor, in the TCon, or on the glass itself implemented with low temperature polysilicon TFTs.

This reduction in acceptable viewing angle is primarily caused by color artifacts that may appear when viewing a sub-pixel rendered image because HSF edges have different values for red, green, and blue sub-pixels. For one example using SPR on the design in FIG. 5A, black text on white background, the green sub-pixels will switch between 100% and 0% while the red and blue sub-pixels will switch from 100% to 50%.

Figure 3:
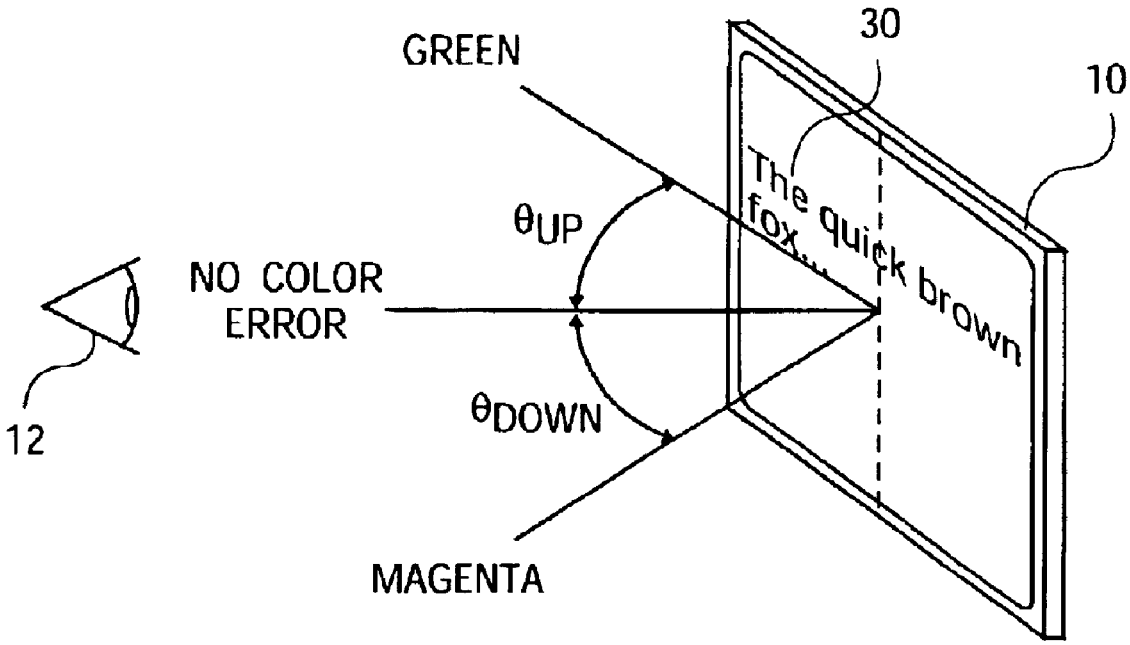
FIG. 3 depicts an observer viewing a display panel and the possible color errors that might be introduced as the observer views sub-pixel rendered text off normal axis to the panel.
Figure 4:
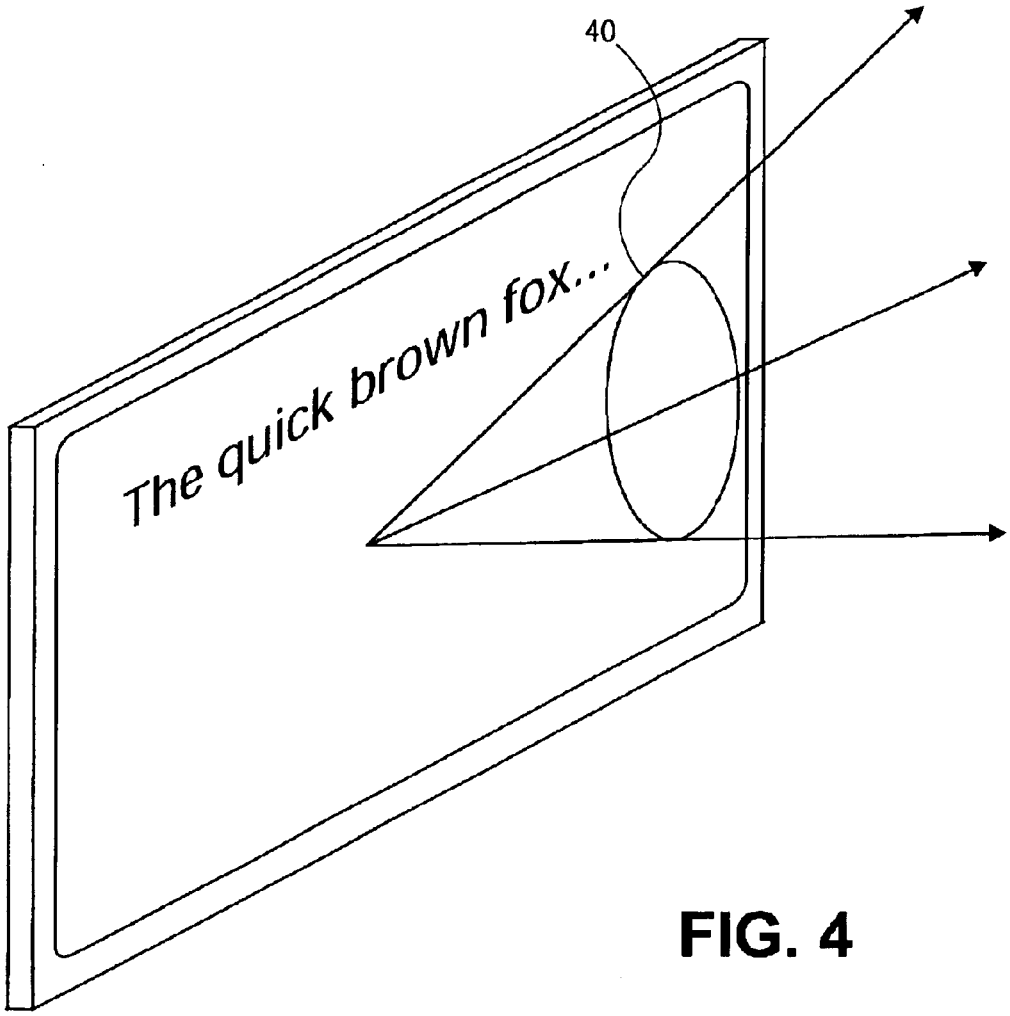
FIG. 4 depicts a display panel and a possible cone of acceptable viewing angles for sub-pixel rendered text once techniques of the present application are applied.

FIG. 3 depicts the situation as might apply to sub-pixel rendered black text 30 on a white background. As shown, observer 12 experiences no color artifact when viewing the text substantially on the normal axis to the panel 10. However, when the observer "looks down or up" on the screen, the displayed data may show a colored hue on a liquid crystal display (LCD), which is due to the anisotropic nature of viewing angle on some LCDs for different gray levels, especially for vertical angles (up/down). Thus it would be desirable to perform corrections to the SPR data in order to increase the acceptable viewing angle 40 of SPR data, as depicted in FIG. 4.

Figure 5A:
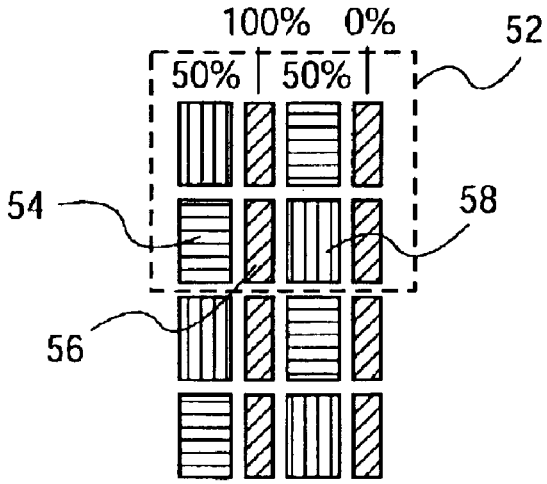
FIG. 5A shows one possible sub-pixel repeat grouping displaying a "white" line on a display having off-normal axis color error.
Figure 5B:
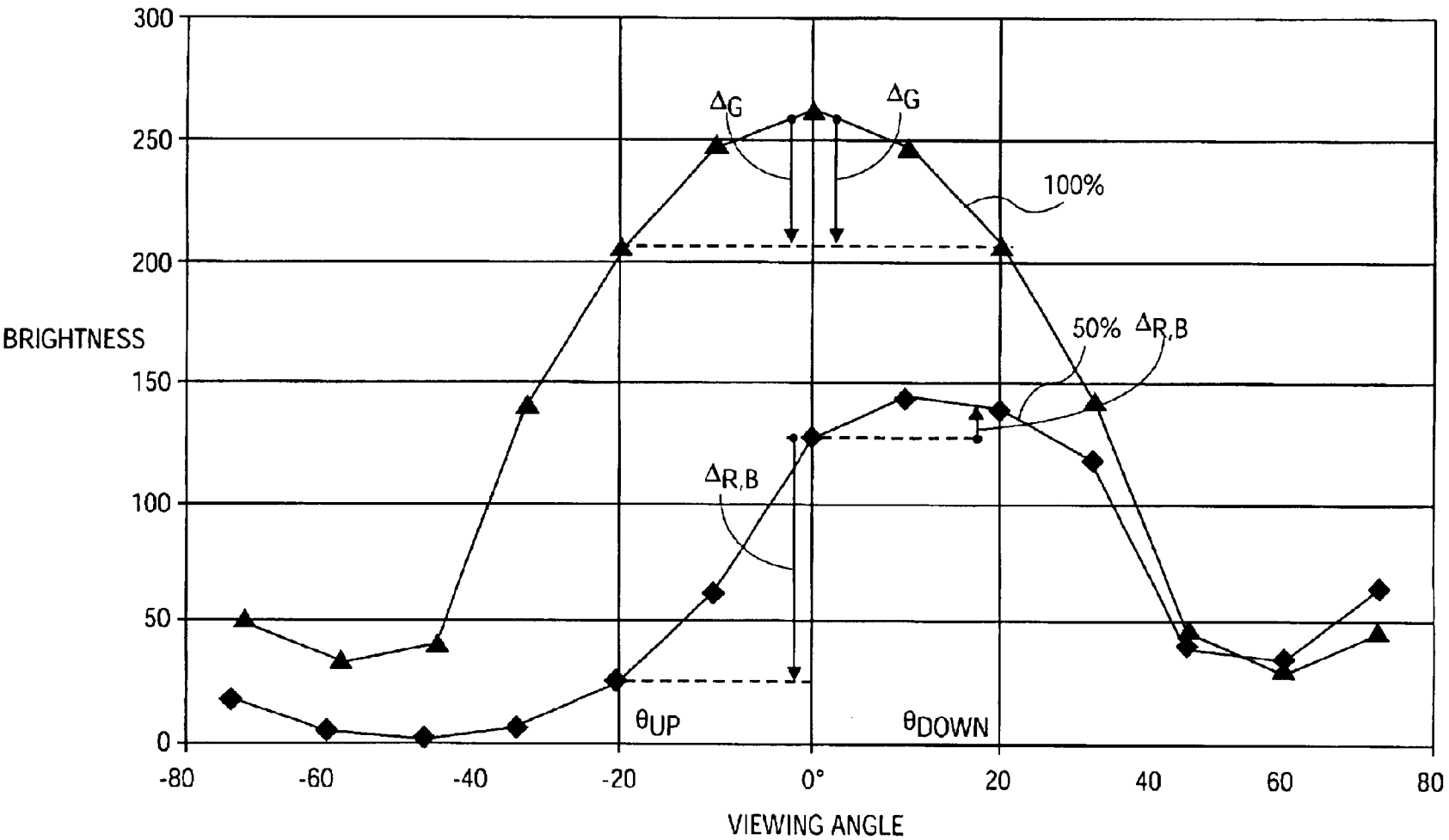
FIG. 5B shows a set of curves of brightness versus viewing angle on a LCD display depicting the performance of the image shown in FIG. 5A.

For illustrative purposes, FIGS. 5A and 5B depict why these color artifacts arise. FIG. 5A shows one possible sub-pixel arrangement upon which SPR may be accomplished, as further described in the above incorporated applications. Sub-pixel repeat group 52 comprises an eight sub-pixel pattern having blue 54, green 56, and red 58 sub-pixels wherein the green sub-pixels are of a reduced width as compared with the red and blue sub-pixels (e.g. one half or some other ratio). In this particular example, a single "white" line is drawn—centered on the middle row of green sub-pixels. As measured on the normal axis, the middle column of green sub-pixels are fully illuminated at 100% brightness level; the blue and the red sub-pixels are illuminated at 50% brightness. Put another way, the green sub-pixel is operating with a filter kernel of [255] (i.e. the "unity" filter, and where '255' is 100% on a digital scale); while the blue and red sub-pixels have a filter kernel of [128 128] (i.e. a "box" filter—where '128' is 50% on a digital scale). At zero viewing angle (i.e. normal to the display), a "white" line is shown because the red and blue sub-pixels are of double width at the green sub-pixels. So with G~100, R~50, B~50, a chroma-balanced white is produced at 100−2×(50)−2×(50), for the case where the size ratio of red to green or blue to green is 2:1. If the size ratio is other than 2, then the multiplier will be adjusted appropriately.

FIG. 5B depicts two curves—the 100% and 50% brightness curve vs. viewing angle—as is well known in for displays such as LCDs. The green sub-pixel performs as the 100% brightness curve; while the blue and red sub-pixels follow the 50% curve. At the normal axis (i.e. viewing angle at 0 degrees), the SPR works well and there is no additional color artifact. As the viewing angle increase to angle $\Theta_{UP}$, then the observer would view a fall-off of $\Delta_G$ in the green sub-pixel brightness—while viewing a $\Delta_{R,B}$ fall-off in the brightness of either the red or the blue sub-pixel brightness. Thus, at $\Theta_1$, there is G'~80, R'~20, B'~20, which results in the image of the white line assuming a more greenish hue—e.g. 80−2×(20)−2×(20). For angle $\Theta_{DOWN}$, the green pixels will again fall off an amount $\Delta_G$, while the red and blue sub-pixels will actually rise an amount $\Delta_{R,B}$. In this case, the white line will assume a magenta hue.

So, to correct for this color artifact, it might be desirable to drive the green sub-pixels—and possibly the red and blue sub-pixels—on a different curve so that the delta fall-off in the green vs the red/blue sub-pixels better match each other as a relative percentage of their total curve. In one embodiment, the green sub-pixels are driven with an "1×3" filter (i.e. a "tent" filter). As discussed further below, this new filter decreases the luminance of the green on high frequency edges so it is closer to the red and blue values.

Figure 6A:
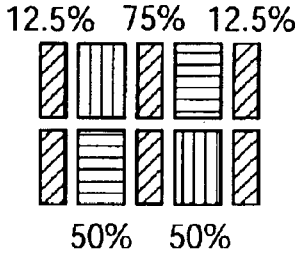
FIG. 6A shows an alternative technique of rendering a "white" line on a display with the same sub-pixel repeat grouping as in FIG. 5A but rendered with less off-normal axis color error.
Figure 6B:
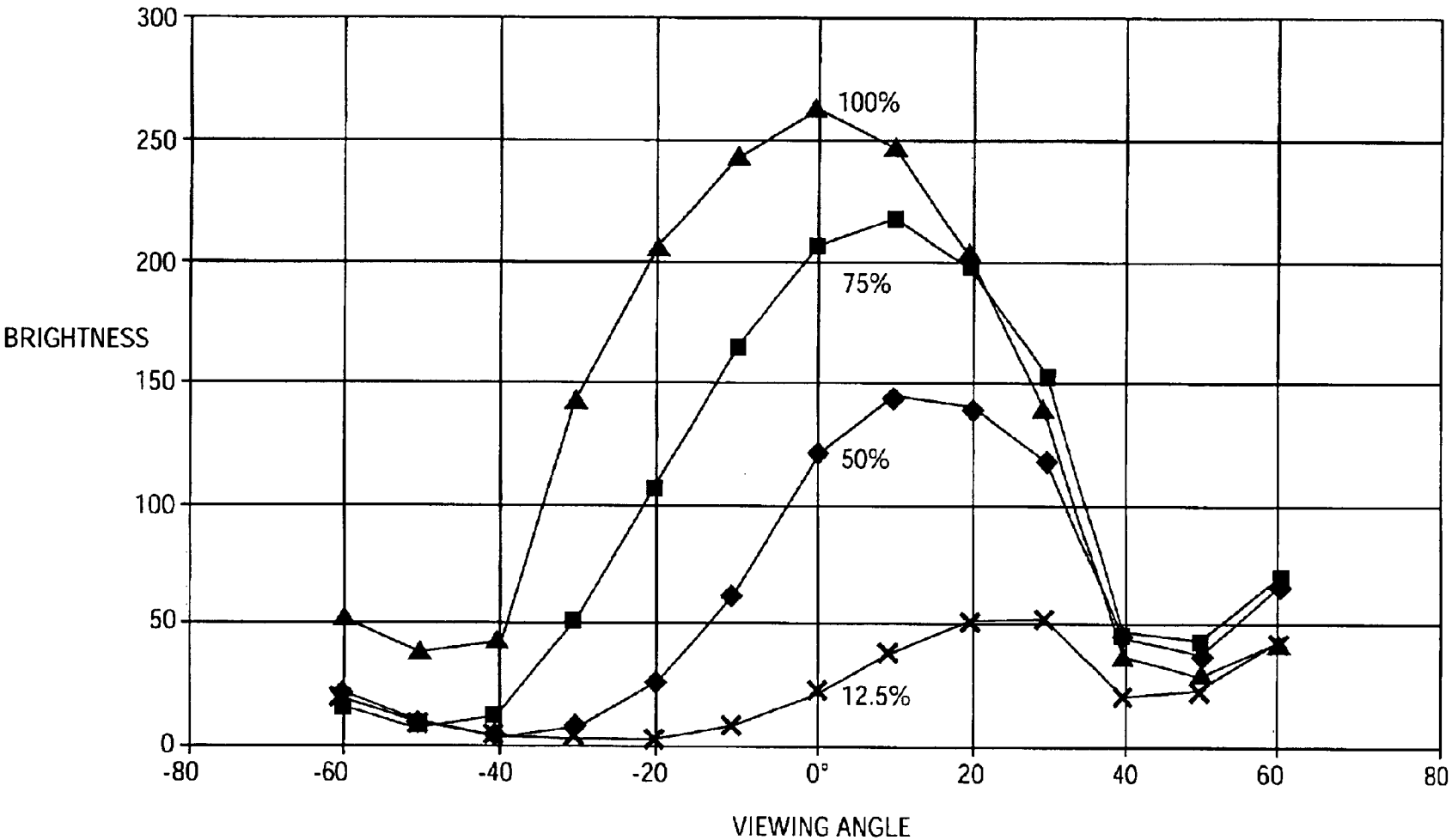
FIG. 6B shows a set of curves of brightness versus viewing angle on a LCD display depicting the performance of the image shown in FIG. 6A.

One embodiment of such a correction is depicted in FIGS. 6A and 6B. In FIG. 6A, a new sub-pixel arrangement is creating the "white" line. Three columns of green sub-pixels are used—with luminances at the 12.5%, 75%, and 12.5% respectively for the left, middle and right green sub-pixel columns. The red and blue sub-pixel checkerboard columns are left at 50%. So, at normal viewing angle (i.e. Θ=0), with G~12.5+75+12.5, R~50, B~50, a similar chroma-balanced "white" line is produced, centered on the middle column of green sub-pixels. Stated in another way, the green sub-pixels are operating on a different tent filter of [32, 192, 32], while the red and blue sub-pixels are operating on the same filter [128 128]—as will be explained further below.

To see what the effect is off-normal axis viewing, refer to FIG. 6B. The 75% and 12.5% curves are much closer in shape to the 50% curve than the 100% curve. Thus the curves are more proportionately constant over viewing angle and the color hue will stay "white".

It will be appreciated that other curves upon which to drive different colored sub-pixels may suffice for the purposes of the present invention. It suffices that the Δ drop in different colors match sufficiently close enough for acceptable viewing performance (i.e. no unacceptable color error at off-normal axis viewing). It will also be appreciated that the same technique of reducing color error will work for other sub-pixel repeat grouping and the discussion contained herein for the particular repeat sub-pixel grouping of FIG. 5A is also merely for illustrative purposes. For any sub-pixel repeat grouping, a set of curves should be appropriately selected to give acceptable viewing performance. Such curves might also vary depending upon the respective geometries of the different colored sub-pixels. Thus, as green sub-pixels are half the width as red and blue sub-pixels in FIG. 5A, an appropriate choice of curves should take such geometries into consideration.

USE OF ADAPTIVE FILTERING AND GAMMA CORRECTION

The techniques described herein may also be used in combination with—and may be enhanced by—other processing techniques; such as adaptive filtering and gamma correction, as disclosed in the '843 application and the '355 application. For example, and as previously noted, the color errors introduced by the off-normal axis viewing angles are more noticeable at regions of high spatial frequencies—such as at edges and other sharp transitions. Thus, detecting areas of high spatial frequency might be important in selectively using the techniques described above for those particular areas.

For example, at an edge transition from light to dark, the green sub-pixel value (operating with the unity filter) goes from 255 to 0 on the aforementioned digital scale. The red and blue sub-pixels (utilizing the box filter) are set to 128 each. Since the viewing angle of 255 and 128 are significantly different for twisted-nematic TN LCDs, there is a color shift. On the other hand, if the green filter is [32 191 32] then the green value goes from 255 to 224 to 32 to 0 (four successive values). The viewing angle characteristics of 224 and 32 are closer to the 128 values (than 255 or 0) of red and blue, so there is less color shift. While there is some loss of sharpness, it is not very noticeable. In addition, gamma correction could also be applied to green or red or blue to improve color matching. More generally, symmetric tent filters for green can be formulated by [f, 1−2f, f]×255. The value for "f" can be anywhere in the 0–20% of total luminance without adversely affecting the "sharpness" of high spatial frequency information, such as text. For LCDs rendering only images, such as television, "f" can be much higher with acceptable results. In addition, the tent filter can be oriented in other directions, such as vertical. In this case, the tent filter would have the values:

| |
|---|
| 32 |
| 192 |
| 32 |

A diagonal filter could also be employed.

Other embodiments—different from the symmetric tent filter for operating the green sub-pixels—are asymmetric box filters, such as [192 63] or [63 192]. These filters also improve the sharpness, but still preserve the improved color performance vs. angle. The new values for an edge (255 to 192 to 63 to 0) are closer to the 128 values of red and blue, so the viewing angle performance may be improved. In this case, there may be an observed asymmetry to the data for left and right edges of a black stroke of a width greater than 1 pixel. In these cases, adaptive filtering can be used to detect whether the edge is "high to low" or "low to high" by looking at 4 pixels in the data set. When high to low is detected, the filter may be [63 192]; for low to high, it may be [192 63]. The adaptive filtering detection is this case is "1100" for high to low or "0011" for low to high, as is further described in the '843 application.

In either case, it is only necessary to employ the tent filter or asymmetric box filter at bright to dark transitions such as black text, where the color error is noticeable. Adaptive filtering can be used to detect light to dark transitions and apply the new filter. Several options exist; in all cases the magnitude of the "step" in brightness can be set by a separate test. The following are representative test cases:

(1) Detect white to black (black text) by looking at all three colors; if all colors change, then apply tent or asymmetric box filter to green, else apply unity filter to green and box filter for red and blue.

(2) Detect bright green to dark green transition but no red and blue transition, then use unity filter for green, box filter for red and blue. It should be appreciated that there might be no need to compensate for viewing angle in this case.

(3) Detect black to white transition (white text) then apply tent or asymmetric box filter to green and box filter to red and blue. For correct brightness, gamma should be applied.

(4) Detect dark green to bright green but no red or blue transition, then use unity filter for green, box filter for red and blue (with gamma). It should be appreciated that there might be no need to compensate for viewing angle in this case.

(5) For red and blue dark to light transitions, it may be desirable to use the standard box filter together with gamma correction. For red and blue light to dark transitions, it may be desirable to use the standard box filter without gamma correction to enhance the darkness of the text strokes.

In all of these cases where gamma is applied, the value of gamma can be selected to obtain best overall performance for that display. It may be different than the gamma of the display.

External Adjustments of Viewing Parameters for Different Viewing Conditions

SPR techniques are typically optimized for each sub-pixel layout and the values are stored in an ASIC, FPGA, or other suitable memory/processing systems. Certain tradeoffs might be desirable according to the preferences of the users. For example, the degree of sharpness of text (or other high spatial frequency information), optimal viewing angle, and color error vs. sharpness conditions are some of the viewing parameters that might be controlled either by applications utilizing the graphical subsystem or by the user itself.

The degree of sharpness may be controlled by varying the filter coefficients as follows:

| No Sharpness: | | |
|---|---|---|
| 0 | 1 | 0 |
| 1 | 4 | 1 |
| 0 | 1 | 0 |

| Intermediate Sharpness: | | |
|---|---|---|
| −¼ | 1 | −¼ |
| 1 | 5 | 1 |
| −¼ | 1 | −¼ |

| Full Sharpness: | | |
|---|---|---|
| −½ | 1 | −½ |
| 1 | 6 | 1 |
| −½ | 1 | −½ |

To control the level of sharpness, the graphic subsystem (such as one embodiment shown as subsystem 20 in FIG. 2) might contain a register containing a value corresponding with varying levels of sharpness (e.g. like the three levels shown above). Either the user could select the sharpness through a physical switch on the system (e.g. PC, or any external display) or a software switch (e.g. Control Panel setting) or an application sending image data to the graphical subsystem could automatically alter viewing settings Alternatively, gamma table values can be adjusted under user control. For example, a low gamma value is desirable for black text; but higher values may be desired for white text. Gamma changes can be either different lookup tables or different functions applied to data. The gamma values can be either the same for positive and negative transitions, or can be different, depending on the display characteristics.

Yet another adjustment input is to adjust peak contrast ratio as a function of viewing angle. LCDs have a peak contrast ratio at a given angle that is set by the voltage applied. This voltage is typically set at the factory and cannot be adjusted by the user. However, it may be desirable to be able to adjust the peak viewing angle—e.g. for black text or high spatial frequency information.

Figure 7:
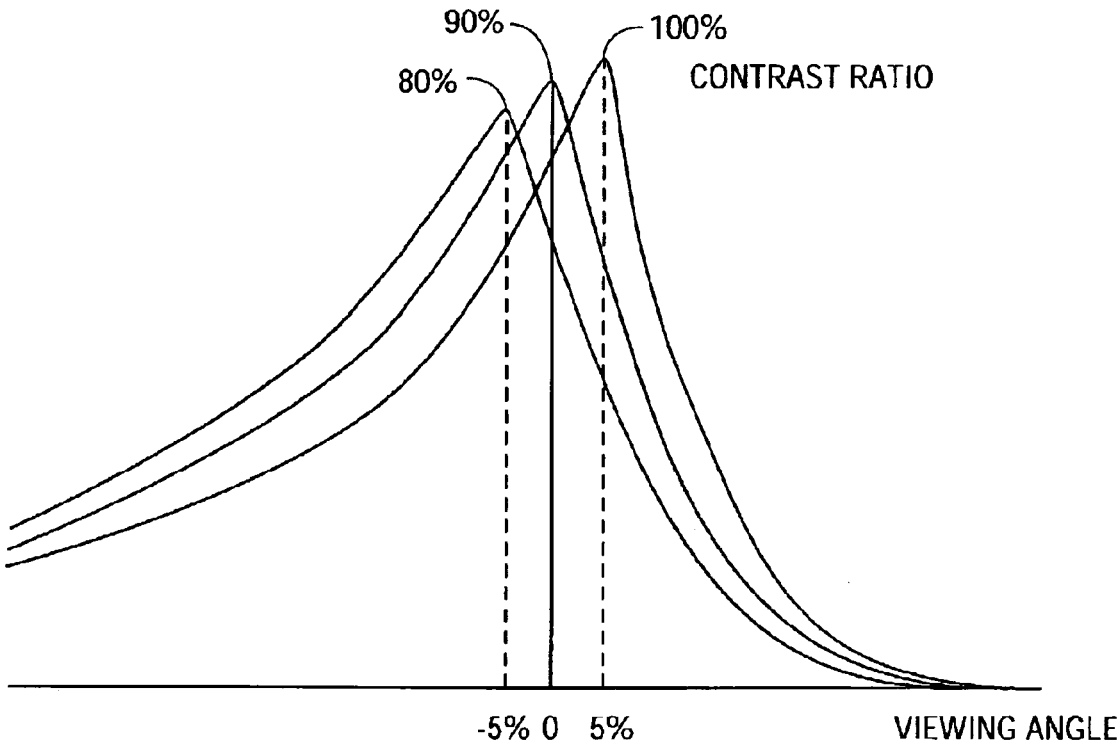
FIG. 7 shows a set of curves of contrast ratio versus viewing angle.

Using the SPR data processing, the voltage corresponding to "100% ON" can be effectively changed by changing the filter coefficients—e.g. for the green sub-pixels in the repeat grouping as shown in FIG. 5A. In a display having a repeat sub-pixel grouping, such as found in FIG. 5A, the peak contrast ratio is determined mostly by the green data—red and blue data contribute but not as much. Even a 5–10% adjustment by the system or by the user would improve viewing conditions based on viewing angle. FIG. 7 depicts a series of three curves plotting contrast ratio vs. viewing angle at three levels of luminance—100%, 90%, and 80%. As may be seen, the peak contrast ratio is achieved at different viewing angles for different luminance levels. This is particularly so in the vertical axis for twisted-nematic TN LCD displays.

Figure 8:
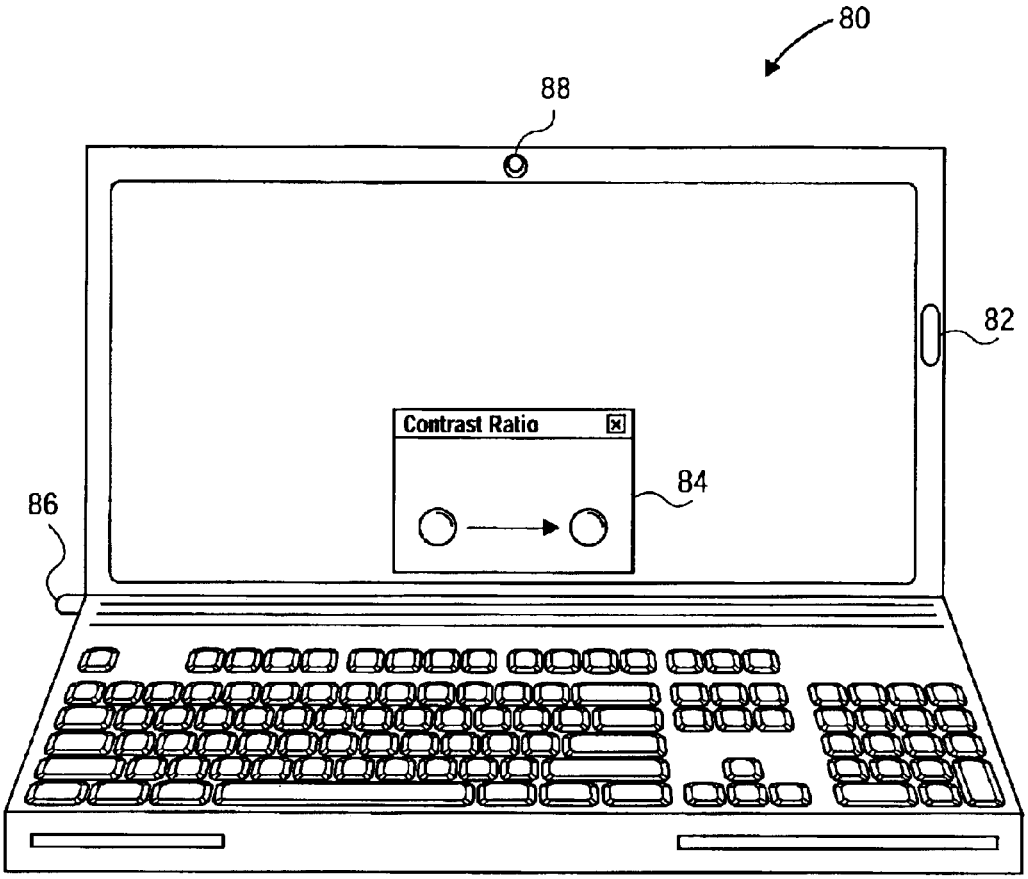
FIG. 8 shows a laptop having a number of different embodiments for adjusting the viewing characteristics of the display by the user and/or applications.

To adjust viewing characteristics such as contrast ratio for the particular user's viewing angle, FIG. 8 depicts a number of separate embodiments for performing such adjustments. Laptop 80 is one possible display platforms to allow such user adjustments. Other platforms might be monitors, cell phones, PDAs and televisions. A first embodiment is a manual physical switch 82 that a user would adjust to get a proper contrast ratio for the user's particular viewing angle. A second embodiment might be a switch in software (shown as a window 84) that allows the user to select a possible contrast ratio setting. Such a soft switch might be activated by individual applications (e.g. word processors, spreadsheet or the like) that access and render data on the display or by the operating system itself. A third embodiment might be automatic adjustment as performed by a switch 86 that notes the angle between the keyboard of the laptop and the display screen itself. This angle would be sufficient to infer the viewing angle of the user with respect to the screen. Based on this inferred viewing angle, the system could automatically adjust the contrast ratio accordingly. A fourth embodiment might be a eye tracking device 88 that notes the position of the user's head and/or eyes and, from that data, calculate the user's viewing angle with respect to the screen.

What is claimed is:

1. In a display system comprising a graphics subsystem, said graphics subsystem further comprising a sub-pixel rendering system, and a display panel being driven by said graphics subsystem wherein said panel further comprises a plurality of colored sub-pixels across said panel, each of said colored sub-pixels further comprising at least one of a group of a first color, a second color and a third color, a method for improving off-normal axis viewing characteristics, the steps of said method comprising:

sub-pixel rendering source image data for display upon the panel; and for any colored sub-pixel data wherein said sub-pixel rendering assigns a unity filter for said colored sub-pixel, substituting a different filter for said colored sub-pixel.

2. The method as recited in claim 1 wherein the step of substituting a different filter further comprises:

applying a tent filter to said colored sub-pixel.

3. The method as recited in claim 2 wherein the step of applying a tent filter further comprises:

applying a horizontal tent filter.

4. The method as recited in claim 2 wherein the step of applying a tent filter further comprises:

applying a vertical tent filter.

5. The method as recited in claim 2 wherein the step of applying a tent filter further comprises:

applying a diagonal tent filter.

6. The method as recited in claim 1 wherein the step of substituting a different filter further comprises:

applying an asymmetric box filter.

7. The method as recited in claim 1 wherein the step of substituting a different filter further comprises:

testing for a condition of transition from a first region of luminance to a second region of luminance in the image data; and applying a different filter depending upon the results of the test.

8. The method as recited in claim 7 wherein the step of testing for a condition further comprises:

testing for a transition from one of a group, said group comprising a transition from a bright region to a dark region in the image data and a transition from a dark region to a bright region.

9. The method as recited in claim 1 wherein said method further comprises the step of:

allowing the user to adjust viewing parameters of the display system.

10. The method as recited in claim 9 wherein the step of allowing the user to adjust viewing parameters further comprises:

allowing the user to adjust the level of sharpness of the display system.

11. The method as recited in claim 9 wherein the step of allowing the user to adjust viewing parameters further comprises:

allowing the user to adjust the level of gamma adjustment of the display system.

12. The method as recited in claim 9 wherein the step of allowing the user to adjust viewing parameters further comprises:

allowing the user to adjust the level of contrast ratio of the display system.

13. A method for a display system comprising a graphics subsystem, said graphic subsystem further comprising a sub-pixel rendering system, and a display panel being driven by said graphic subsystem wherein said panel further comprises a plurality of colored sub-pixel across said panel, each of said colored sub-pixels further comprising at least one of a group of a first color, a second color and a third color, the method for improving off-normal axis viewing characteristic, the method comprising:

configuring the graphic subsystem to:

sub-pixel render source image data for display upon the panel; and for any colored sub-pixel rendering assigns a unit filter for said colored sub-pixel, substitute a different filter for said colored sub-pixel.

* * * * *